US007061390B2

(12) United States Patent
Murata

(10) Patent No.: US 7,061,390 B2
(45) Date of Patent: Jun. 13, 2006

(54) MOVEMENT DETECTION SENSOR AND MOVEMENT DETECTION DEVICE

(76) Inventor: Masami Murata, 7-5-805, 4Bancho, Chiyoda-ku, Tokyo (JP) 102-0081

( * ) Notice: Subject to any disclaimer, the term of this patent is extended or adjusted under 35 U.S.C. 154(b) by 0 days.

(21) Appl. No.: 10/647,003

(22) Filed: Aug. 22, 2003

(65) Prior Publication Data

US 2004/0046675 A1 Mar. 11, 2004

(51) Int. Cl.
*G08B 21/00* (2006.01)

(52) U.S. Cl. ..... 340/686.1; 340/571; 340/686.2; 340/689; 324/227

(58) Field of Classification Search ..... 340/539.26, 340/539.15, 539.23, 539.27, 571
See application file for complete search history.

(56) References Cited

U.S. PATENT DOCUMENTS

| | | | | |
|---|---|---|---|---|
| 3,631,271 | A * | 12/1971 | Shimada | 310/326 |
| 4,869,251 | A * | 9/1989 | Lekholm et al. | 607/19 |
| 5,001,460 | A * | 3/1991 | Basson | 340/571 |
| 5,183,056 | A * | 2/1993 | Dalen et al. | 600/595 |
| 5,408,214 | A * | 4/1995 | Chalmers et al. | 340/436 |
| 5,844,482 | A * | 12/1998 | Guthrie et al. | 340/572.4 |
| 5,999,091 | A * | 12/1999 | Wortham | 340/431 |
| 6,046,678 | A * | 4/2000 | Wilk | 340/686.1 |
| 6,265,974 | B1 * | 7/2001 | D'Angelo et al. | 340/568.1 |
| 6,301,795 | B1 * | 10/2001 | Kang | 33/366.12 |
| 6,323,446 | B1 * | 11/2001 | Schnell | 200/61.52 |
| 6,377,166 | B1 * | 4/2002 | Cauchi | 340/429 |
| 6,826,844 | B1 * | 12/2004 | Endo et al. | 33/366.24 |
| 2002/0118167 | A1 * | 8/2002 | Mei et al. | 345/163 |

FOREIGN PATENT DOCUMENTS

| | | |
|---|---|---|
| JP | 62-225030 | 10/1987 |
| JP | 02-138875 | 5/1990 |
| JP | 03-140874 | 6/1991 |
| JP | 07-271506 | 10/1995 |

* cited by examiner

*Primary Examiner*—Daniel Wu
*Assistant Examiner*—Son Tang
(74) *Attorney, Agent, or Firm*—Welsh & Katz, Ltd.

(57) ABSTRACT

A first movement detection sensor comprises a void formed by a partition wall made of a non-magnetic material, a magnetized rolling member which is sealed inside the void, and a magnetic sensor provided in the partition wall. A second movement detection sensor is configured by positioning the rolling member in the substantial center of the void and then filling the void with a visco-elastic body until the visco-elastic body abuts against the rolling member. A movement detection device is constructed by annexing an amplifying circuit, a transmitting circuit, a differentiating circuit, and so on to the first movement detection sensor and second movement detection sensor.

12 Claims, 7 Drawing Sheets

MOVEMENT DETECTION SENSOR AND MOVEMENT DETECTION DEVICE

BACKGROUND OF THE INVENTION

1. Field of the Invention

The present invention relates to a movement detection sensor and a movement detection device which are used while being fixed to a detection subject such as a piece of furniture, a work of art, a box for valuable articles, a vending machine or automated teller machine, an animal, or a human body, and thus detect movement and stillness in the detection subject.

2. Description of the Related Art

Accelerometers and seismographs are known as devices for detecting the movement or motion of a detection subject.

These are used to detect the attitude of an airplane or vibration of the surface of the ground, and are comparatively large devices with a high level of measurement precision.

On the other hand, theft prevention sensors which detect a carrying-away of a portable safe or the like are also known, and such sensors detect movement in the detection subject by detecting the change in the relative positional relationship between the detection subject to which the sensor is fixed and a shelf board, wall surface or the like which supports the detection subject, for example.

However, the following problems exist in the technology described above.

That is, devices such as accelerometers and seismographs have complicated configurations and are therefore expensive. Moreover, attachment of the devices to the detection subject is not easy.

Conventional theft prevention sensors detect movement in the detection subject by detecting the relative positional relationship of the detection subject and another object such as a shelf board or wall surface, and hence a problem arises in that detection cannot be performed if errors are made in the attachment position or attachment method of the sensor. Another problem lies in the fact that such sensors cannot be used for detection subjects which are in constant motion or frequently altered in attitude.

SUMMARY OF THE INVENTION

An object of the present invention is to provide a movement detection sensor and a movement detection device which can be manufactured in an extremely small size and which can be attached easily in any position on a detection subject. For example, the present invention provides a movement detection sensor and movement detection device which can be used to detect attitude changes or movement of detection subjects such as furniture, works of art, boxes for valuable articles and to detect a continuous normal motion of an animal or human, by attaching the sensor to these detection subjects.

In order to achieve the object of the present invention, a first aspect of the present invention is a movement detection sensor comprising a void formed by a partition wall made of a non-magnetic material, a magnetized rolling member sealed inside the void, and a magnetic sensor disposed on the partition wall.

A second aspect of the present invention is the movement detection sensor in which the void is formed in spherical or regular polyhedron form, and the rolling member is a sphere or a regular polyhedron.

A third aspect of the present invention is a movement detection device comprising the movement detection sensor of the first aspect of the present invention or second aspect of the present invention, an amplifying circuit for amplifying an output signal of the magnetic sensor in the movement detection sensor, and a transmitting circuit for radio-transmitting a detection signal amplified in the amplifying circuit.

A movement detection sensor of the first aspect of the present invention and second aspect of the present invention comprises a void which is defined by a partition wall formed from a non-magnetic material, a magnetized rolling member which is sealed inside the void, and a magnetic sensor which is provided in the partition wall.

When detecting two-dimensional movement, the void may be formed in tubular form or drum-form, but is basically either spherical or in a regular polyhedron form. For example, the void is formed as a sphere by sealing together plastic components provided with hemispheric concave spaces.

For practical use, the size of the void is approximately several millimeters.

The magnetic sensor can be attached by forming a through hole in one location on the peripheral wall of the void.

The void having a spherical or regular polyhedron form is advantageous in that the direction in which the sensor is attached is not limited, and even if the attitude of the detection subject changes, detection is always possible.

The rolling member is a so-called permanent magnet in spherical or regular polyhedron form.

When both the void and rolling member are formed as spheres, minute movements and variations in the attitude of the detection subject can be detected. When either the void or the rolling member is formed as a regular polyhedron, a threshold can be provided for the precision of detection.

More specifically, in the movement detection sensor of the first aspect of the present invention and second aspect of the present invention, relative movement of the rolling member inside the void is detected by the magnetic sensor, and when both the void and rolling member are formed as spheres, the relative position of the rolling member changes in response to even slight tilting or movement of the void. When the void or rolling member is a regular polyhedron, on the other hand, the rolling member does not roll in response to slight tilting or movement of the void, and thus the relative position thereof inside the void does not change. The rolling member begins to roll or slide only when the tilting or movement of the void exceeds a certain threshold.

Accordingly, a desired sensor threshold (sensitivity) can be set by appropriately selecting the number of faces of the polyhedron.

The movement detection device of the third aspect of the present invention comprises the movement detection sensor of the above configuration, an amplifying circuit for amplifying an output signal of the magnetic sensor in the movement detection sensor, and a transmitting circuit for radio-transmitting a detection signal amplified in the amplifying circuit.

A transmitting circuit of a portable telephone or PHS may be used as the transmitting circuit. These transmitting circuits are integrated as an IC and therefore extremely small, and are also capable of transmitting detection signals using a public wireless communication system.

By using a transmitting circuit used in the cordless handset of a telephone, for example, the detection signals of a plurality of movement detection sensors may be transmitted through a single public communication line.

A fourth aspect of the present invention is a movement detection sensor comprising a void formed by a partition wall made of a non-magnetic material, a magnetized rolling member sealed inside the void, a visco-elastic body which is filled into the void so as to abut against and envelop the rolling member, and a magnetic sensor provided in the partition wall.

According to the fourth aspect of the present invention, vibration of the rolling member which is enveloped and abutted by the visco-elastic material is detected by the magnetic sensor, and thus vibration of the detection subject to which the movement detection sensor is attached can be detected.

Furthermore, the movement detection sensor is configured by four small components, i.e. the partition wall, the rolling member, the visco-elastic body, and the magnetic sensor. Therefore, the movement detection sensor is a compact in size and has a simple configuration.

A fifth aspect of the present invention is a movement detection device comprising the movement detection sensor of the fourth aspect of the present invention, a differentiating circuit for differentiating an output signal of the magnetic sensor in the movement detection sensor, an amplifying circuit for amplifying an output signal of the differentiating circuit, and a transmitting signal for radio-transmitting a detection signal amplified in the amplifying circuit.

According to the fifth aspect of the present invention, vibration of the rolling member detected by the magnetic sensor is differentiated by the differentiating circuit to calculate an acceleration, and the calculated acceleration is transmitted by the transmitting circuit.

In so doing, acceleration can be monitored in real time from a remote location away from the movement detection device, and as a result, damage and breakage caused by collisions, dropping, and so on of the detection subject can be confirmed rapidly.

A sixth aspect of the present invention is a movement detection device comprising the movement detection device of the third aspect of the present invention or the fifth aspect of the present invention and a microcomputer for storing and judging the aforementioned detection signal.

The sixth aspect of the present invention is configured that detection data are stored in the microcomputer, and the stored data can be reproduced following the completion of detection of the detection subject.

With the configuration, the movement history of a care-receiver, for example, can be recorded, thereby facilitating the management of health care facilities.

A seventh aspect of the present invention is a movement detection device comprising the movement detection device of the third aspect of the present invention, the fifth aspect of the present invention, or the sixth aspect of the present invention, and a radio wave receiver attached to the movement detection device for receiving radio waves, wherein the radio wave receiver receives radio waves from a radio wave transmitter positioned at a predetermined distance from the movement detection device, and the movement detection device begins operations when the field intensity of the received radio waves falls below a predetermined value.

According to the seventh aspect of the present invention, the movement detection device begins operations when the movement detection device moves a predetermined distance or more away from a person carrying the radio wave transmitter, for example.

With this configuration of the seventh aspect of the present invention, a determination can be made as to whether a cash box to which the movement detection device is attached, for example, is in motion or stationary when the cash box moves away from a cash delivery vehicle, and thus theft of the cash box can be forestalled.

An eighth aspect of the present invention is a movement detection device comprising the movement detection device of the third aspect of the present invention, the fifth aspect of the present invention, or the sixth aspect of the present invention, a temperature sensor for detecting the temperature of a detection subject, and an attachment tool for attaching the movement detection device and the temperature sensor to the detection subject.

According to the eighth aspect of the present invention, the movement detection device and temperature sensor are attached to the detection subject by the attachment tool.

With this configuration of the eighth aspect of the present invention, the state of movement and the temperature of the detection subject can be monitored in detail from a remote location, and thus accidents to the detection subject when the detection subject is wandering or bathing can be forestalled.

DESCRIPTION OF THE PREFERRED EMBODIMENTS

Figure 1:
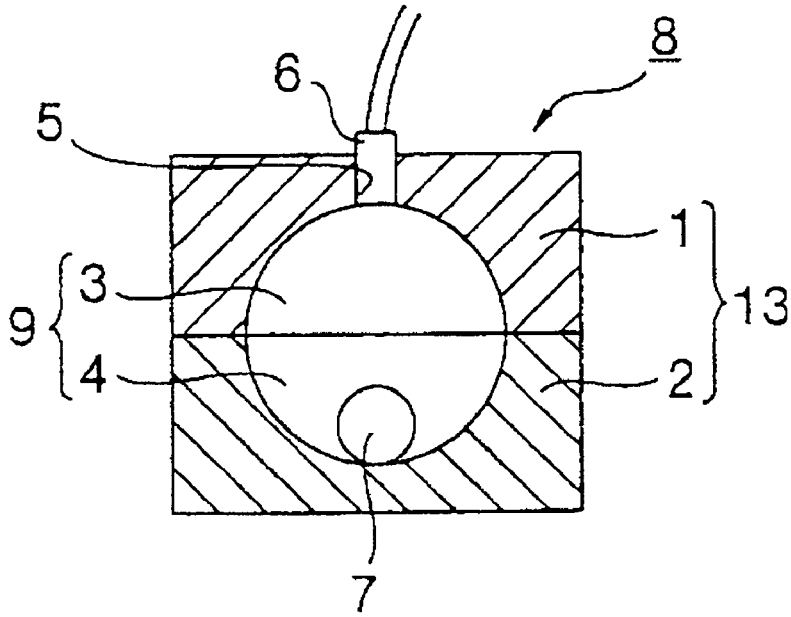
FIG. 1 is a sectional view showing a first embodiment of a movement detection sensor.

FIG. 1 is a sectional view showing a first embodiment of a movement detection sensor of the present invention.

A base plate 1 and a lid plate 2 in the form of a regular hexahedron divided into two are formed by plastic molding, and concave spaces 3, 4 in hemispherical form are formed on the contact surfaces thereof. A through hole 5 which penetrates the bottom face of the concave space 3 is provided in the base plate 1.

The through hole 5 matches with the outer diameter of a magnetic sensor 6, and the magnetic sensor 6 is fitted into the through hole 5 such that the detection end thereof faces toward the concave space 3.

A rolling member 7 is configured by a spherical permanent magnet, and the base plate 1 and lid plate 2 are joined with the rolling member 7 inserted into the concave spaces 3, 4. Thus the rolling member 7 is sealed inside a void 9 formed by the concave spaces 3, 4.

The magnetic sensor 6 has an outer diameter of approximately 5–10 mm.

A movement detection sensor 8 formed in this manner can be easily attached to a detection subject by being adhering thereto via adhesive tape or the like which is adhered to the outer surface of the lid plate 2.

Alternatively, a latching portion such as a cord or belt may be provided on the base plate 1 or lid plate 2 such that the sensor 8 is attached to the detection subject by this cord or belt.

The movement detection sensor 8 is usually attached to a detection subject such as a stationary piece of furniture, work of art and box of valuable articles to monitor the output of the magnetic sensor 6. By connecting the magnetic sensor 6 to a warning device which emits a warning when variation is detected in the output of the magnetic sensor 6, theft of the furniture, work of art, and so on can be detected.

Figure 2:
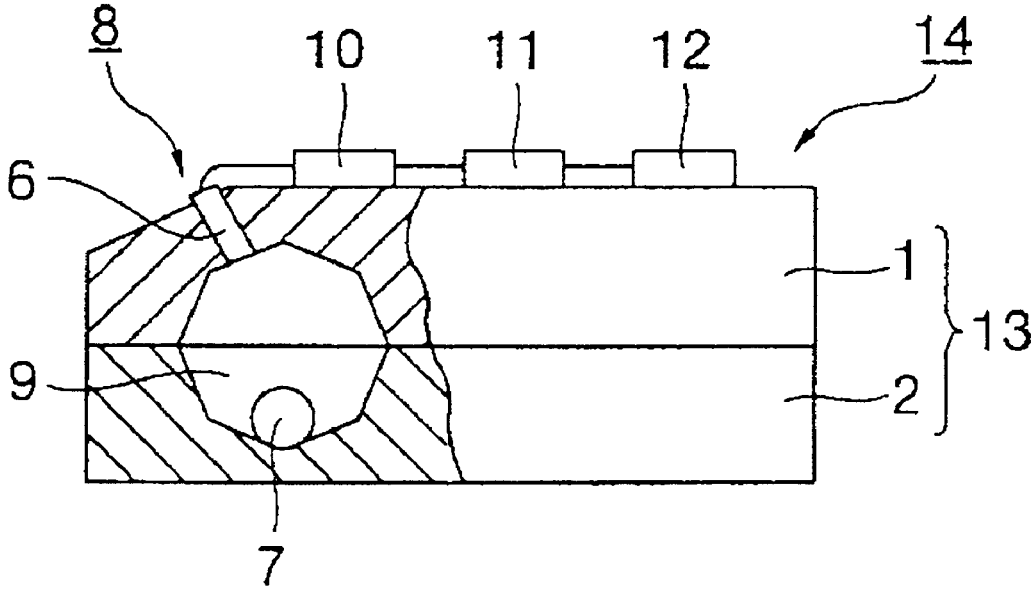
FIG. 2 is a sectional view showing a first embodiment of a movement detection device.
Figure 3:
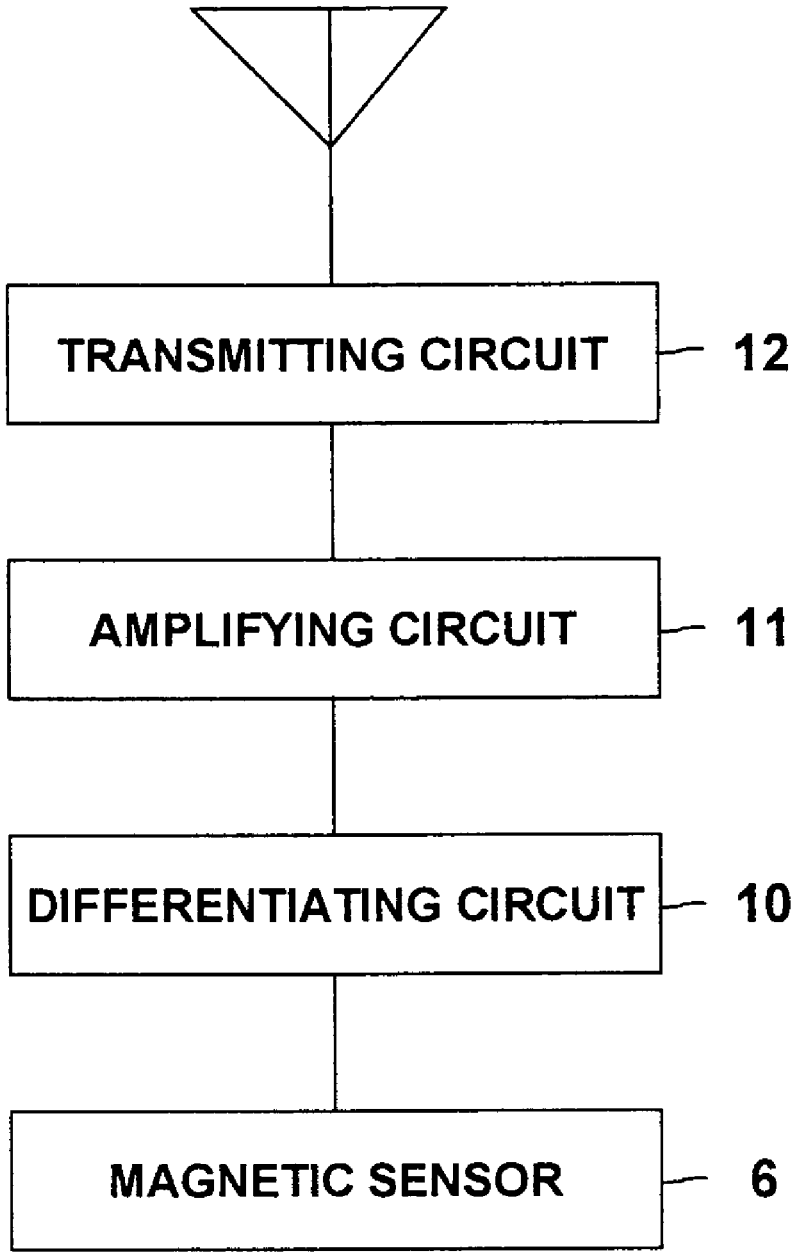
FIG. 3 is a block diagram of an embodiment of the movement detection device.

FIGS. 2 and 3 are views showing an embodiment of a movement detection device 14 of the present invention.

The void 9 of the movement detection sensor which constitutes the movement detection device 14 of this embodiment is in regular polyhedron form, and is formed at the joining face of the base plate 1 and lid plate 2 according to a similar method to that of the movement detection sensor 8 of the first embodiment.

The rolling member 7 is sealed inside the void 9, and the magnetic sensor 6 is attached to the base plate 1 side of the void 9 in a similar configuration to that of the movement detection sensor 8 of the first embodiment.

A differentiating circuit 10, an amplifying circuit 11, and a transmitting circuit 12 for a portable telephone are also connected, and these circuits are integrated as an IC and placed on the base plate 1.

A timer or threshold setting circuit may be provided on the base plate 1 according to necessity.

The actions and effects of the movement detection device 14 having the configuration described above will now be described.

First, an example in which the movement detection device 14 is applied to the prevention of theft of a valuable article such as a piece of furniture, a work of art, or a jewelry box will be described referring to FIG. 4.

The movement detection device 14 is attached to a valuable article 20 by adhesive tape 21 adhered to the outer surface of the movement detection device 14 or by a cord or belt latched to the base plate 1 or lid plate 2, so that the output of the magnetic sensor 6 transmitted from the transmitting circuit 12 is monitored.

When the valuable article 20 moves from a stationary state to a state of movement, the rolling member 7 moves within the void 9 such that the distance between the magnetic sensor 6 and the rolling member 7 varies, and thus the output voltage of the magnetic sensor 6 varies.

By activating the transmitting circuit 12 to call a preset telephone when the output voltage varies, theft of the valuable article 20 can be monitored from a remote location.

Figure 5:
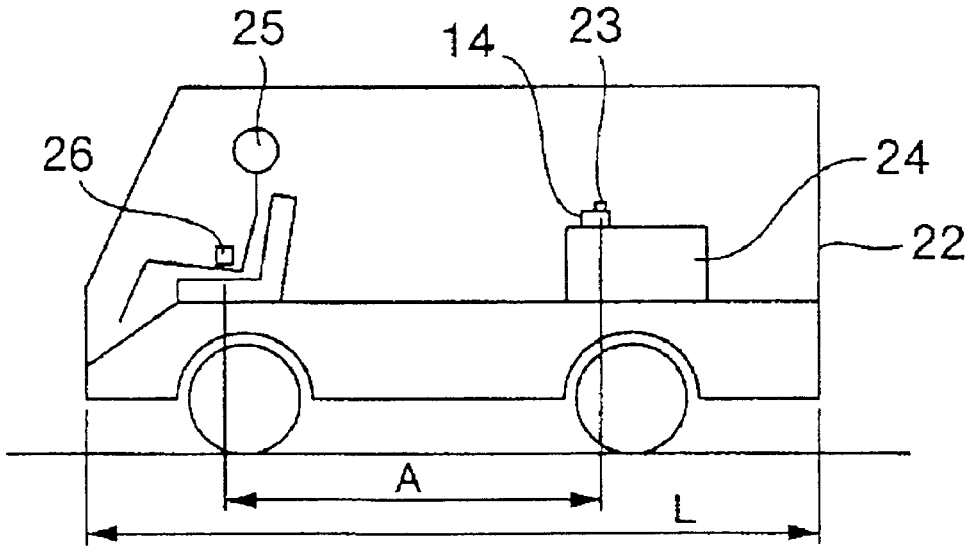
FIG. 5 is an illustrative view showing the application of the movement detection device to a cash delivery vehicle.

Next, the actions and effects of the movement detection device 14 will be described by referring to, by way of an example, the security of a cash delivery vehicle 22 as shown in FIG. 5.

The movement detection device 14, to which a radio wave receiver 23 is attached, is affixed to a cash box 24 in the loading compartment.

Meanwhile, a driver 25 or assistant in the driver's cabin carries a radio wave transmitter 26.

When the distance A between the radio wave transmitter 26 and radio wave receiver 23 is equal to or less than a maximum length L of the cash delivery vehicle 22, the radio wave receiver 23 determines that the field intensity of the radio wave received from the radio wave transmitter 26 is equal to or higher than a predetermined value, and hence does not operate the movement detection device 14 so that vibration in the cash delivery vehicle 22 is not detected.

When the distance A exceeds the maximum length L, or in other words, when the field intensity equals or falls below the predetermined value, the movement detection device 14 is activated.

An output voltage of the magnetic sensor 6 is then transmitted from the transmitting circuit 12, and a determination is made as to whether or not the cash box 24 is in motion.

As a result of this determination, a determination can be made as to whether or not the cash box 24 is in motion in a position exceeding the maximum length L from the driver 25 or assistant, and hence theft of the cash box 24 can be prevented.

Next, actions and effects of the movement detection device 14 will be described by referring to, by way of an example, the accident prevention of a care-receiver.

Figure 6:
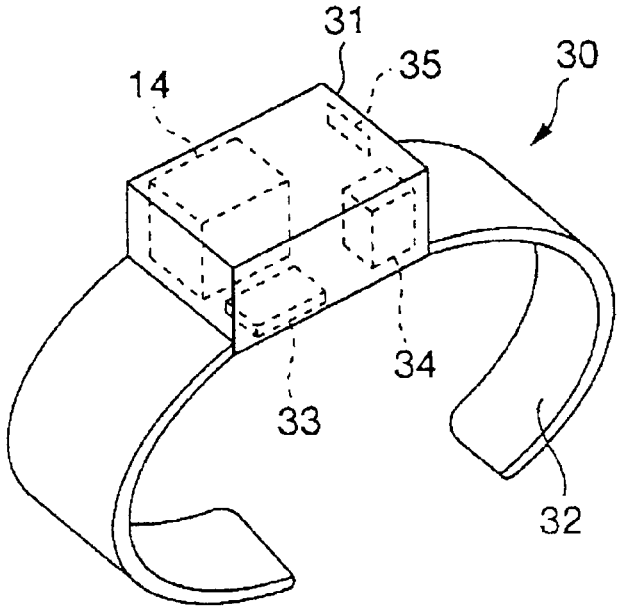
FIG. 6 is an illustrative view showing the application of the movement detection device to a care monitor.

As shown in FIG. 6, a care monitor 30 is provided with a belt 32 which serves as an attachment tool for attaching to a care-receiver the care monitor 30 and a waterproof casing 31 in which the movement detection device 14 and so on are installed.

A temperature sensor 33 such as a thermistor, for example, which measures body temperature by directly contacting the arm, leg, or another part of the care-receiver is provided in a predetermined position in the casing 31.

A microcomputer 34 for storing and judging data outputted from the movement detection device 14 and temperature sensor 33 is also loaded into the casing 31.

An output port 35 for outputting the data stored in the microcomputer 34 to an external printer or the like is also provided.

The care-receiver attaches the care monitor 30 to an arm, leg, or the like by the belt 32 such that the temperature sensor 33 contacts the arm, leg, or the like.

Movement of the care-receiver is detected by the movement detection sensor 14 inside the casing 31, and the body temperature of the care-receiver is detected by the temperature sensor 33.

For example, if the microcomputer 34 determines that the care-receiver is not moving and that his/her body temperature has fallen to or below 30° C., messages and warnings are transmitted automatically from the transmitting circuit 12 of the movement detection device 14 to a plurality of pre-recorded contacting destinations.

If a provision is made in relation to the timer (not shown) provided on the base plate 1 such that the transmitting circuit 12 is operated when the output of the movement detection device 14 does not change for a fixed amount of time, the movement detection device 14 may also be used to detect irregularities in the body of the care-receiver.

Hence the care-receiver can be monitored twenty-four hours a day, even during bathing, and as a result accidents to the care-receiver can be forestalled.

Moreover, movement data and temperature data accumulated over a predetermined time period can be printed out from the output port 35, whereby a health history of the care-receiver can be recorded, thus facilitating health management.

Figure 4:
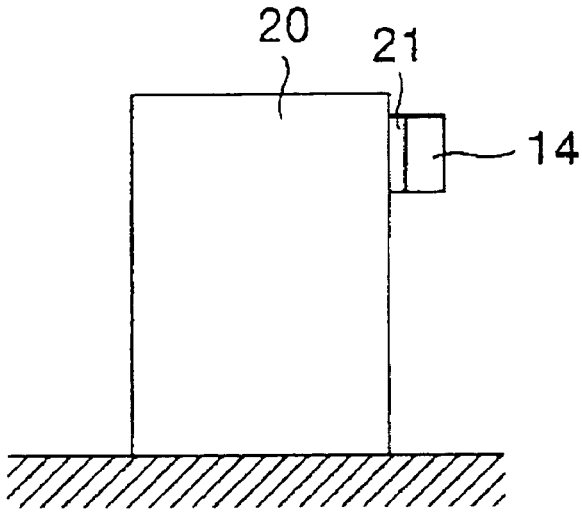
FIG. 4 is an illustrative view showing the application of the movement detection device to a detection subject in a fixed position.

The movement detection device 14 described by referring to FIGS. 4, 5, and 6 is configured by small components including the partition wall 13, the rolling member 7, the magnetic sensor 6, the differentiating circuit 10, amplifying circuit 11, and transmitting circuit 12, and is formed with a simple and compact configuration. Hence the movement detection device 14 can be attached easily in any position on the detection subject.

Since the transmitting circuit 12 is that for a portable telephone, the position of the valuable article 20, cash box 24, or care-receiver can be specified quickly by tracing the transmission position, thereby facilitating accident prevention.

Instead of the transmitting circuit 12 for a portable telephone, a configuration is possible in which the transmitting circuit 12 is connected to a regular subscriber telephone through a wire. A configuration is also possible in which signals from the movement detection device 14 are transmitted to a remote radio receiver through a radio transmitter, and display, warning, and so on are performed on the basis of the signals received in the radio receiver.

Figure 7:
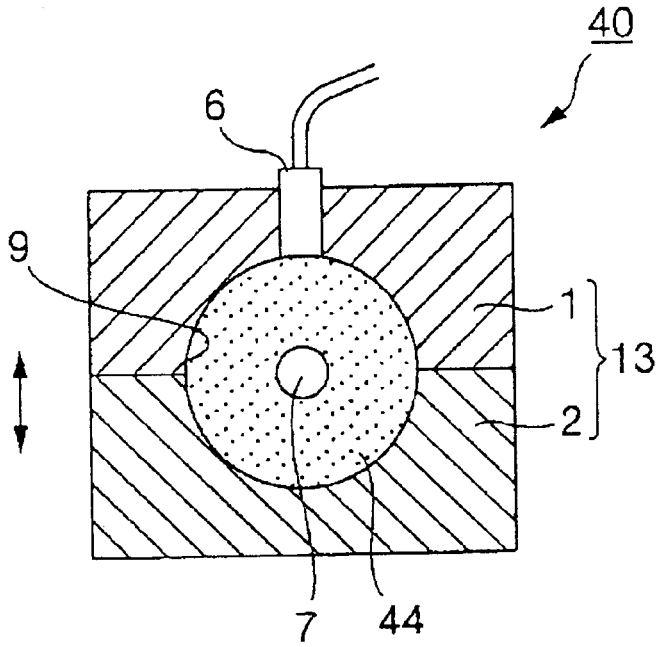
FIG. 7 is a sectional view of a second embodiment of the movement detection sensor.

FIG. 7 shows a sectional view of a second embodiment of a movement detection sensor.

A movement detection sensor 40 is formed such that the rolling member 7 is positioned in a substantially central portion of the void 9 in the movement detection sensor 8 described in FIG. 1, and such that a visco-elastic body 44 such as sponge, for example, is filled into the void 9 until the visco-elastic body 44 abuts against the rolling member 7.

When the partition wall 13 vibrates in the direction of the arrow in the drawing, the rolling member 7 vibrates in the direction of the arrow within the visco-elastic body 44, and this vibration is detected by the magnetic sensor 6.

Figure 8:
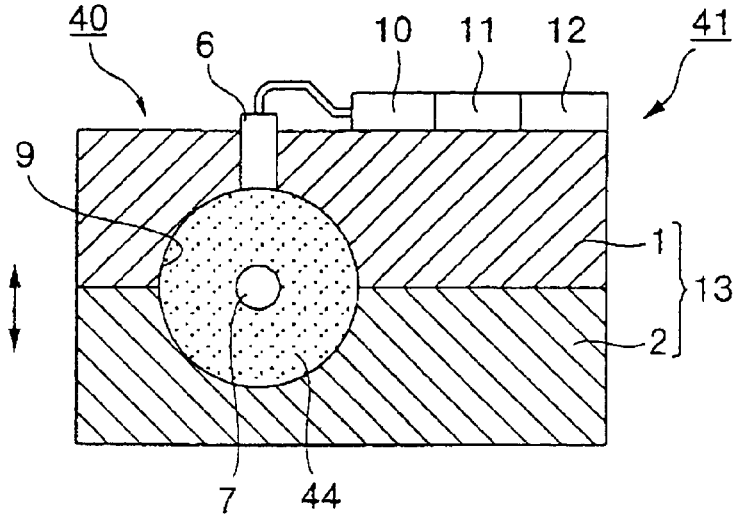
FIG. 8 is a sectional view of an acceleration sensor using the movement detection sensor of the second embodiment.

FIG. 8 is a sectional view of a movement detection device 41 using the movement detection sensor 40 of FIG. 7. A differentiating circuit 10, an amplifying circuit 11, and a transmitting circuit 12 for a portable telephone are connected to the output side of the magnetic sensor 6, and these circuits are integrated as an IC and placed on the base plate 1.

The output voltage of the magnetic sensor 6 is differentiated by the differentiating circuit 10, whereby an acceleration having a main component in an arrow direction in the FIG. 8 is calculated, and the calculated acceleration is passed through the amplifying circuit 11 to the transmitting circuit 12 and transmitted from the transmitting circuit 12.

Figure 9:
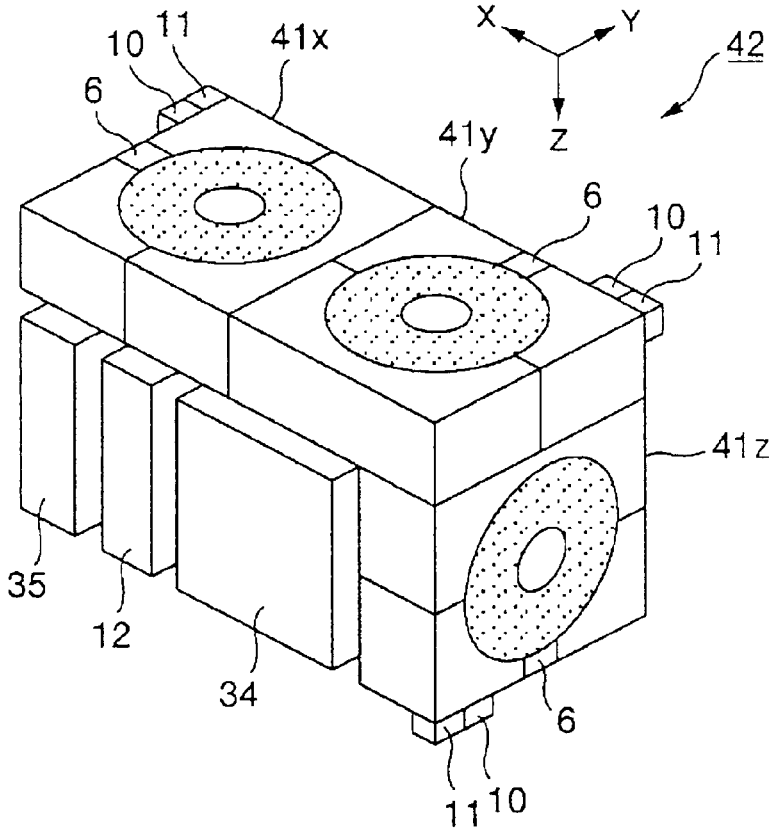
FIG. 9 is an illustrative view of an acceleration detection device configured by a plurality of acceleration sensors.

FIG. 9 shows an acceleration detection sensor 42 which is a modification of the movement detection device.

The acceleration detection sensor 42 comprises three movement detection devices 41*x*, 41*y*, 41*z* disposed in three directions X, Y, Z.

The output of the amplifying circuits 11 in these movement detection devices 41*x*, 41*y*, 41*z* is connected to a microcomputer 34 which stores and judges acceleration data.

A transmitting circuit 12 for transmitting the acceleration data is provided to prepare for a case in which it is determined that the acceleration data obtained by the microcomputer 34 are to be transmitted to a remote monitoring station.

An output port 35 for outputting the stored acceleration data to an external printer or the like is also provided.

The effects of the acceleration detection device 42 configured as described above will now be described.

Figure 10:
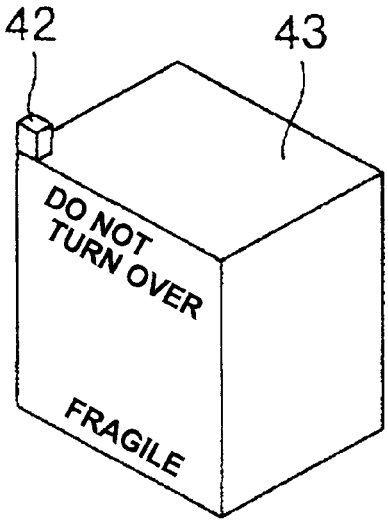
FIG. 10 is an illustrative view showing the application of the acceleration detection device to a transported shipping container.

Referring to FIG. 10, the acceleration detection device 42 is attached in a predetermined position on a shipping container 43 for transporting goods which are fragile and must not be turned over.

The acceleration detection device 42 detects acceleration in directions X, Y, and Z, and the detected acceleration is stored in the microcomputer 34. If the shipping container 43 or the contents of the shipping container 43 are damaged when the shipping container 43 is received by a consignee, the acceleration data are printed out from the microcomputer 34 via the output port 35.

If acceleration equal to or exceeding a threshold is outputted, it is determined that the shipping container 43 was subject to handling in violation of rules such as dropping, collision, or overturning during the transportation process.

The microcomputer 34 is also provided with a clock and can specify the time at which acceleration at or above the threshold occurred. Hence a responsibly party for the damage can be specified easily.

The acceleration detection device 42 is configured by a small number of components and has a simple and compact configuration, and can therefore be easily attached in any position on a detection subject.

The movement detection device 41 described above or the acceleration detection device 42 may be used in place of the movement detection device 14 described in FIGS. 4, 5, and 6.

Note that in the movement detection device 41 or the acceleration detection device 42 of the embodiment described above, the visco-elastic body 44 is filled into the spherical void 9 of the movement detection sensor 8 described in FIG. 1. However, the form of the void 9 is not limited to a spherical as long as a condition, i.e., the periphery of the rolling member 7 is supported uniformly by the visco-elastic body 44, is satisfied.

Figure 11:
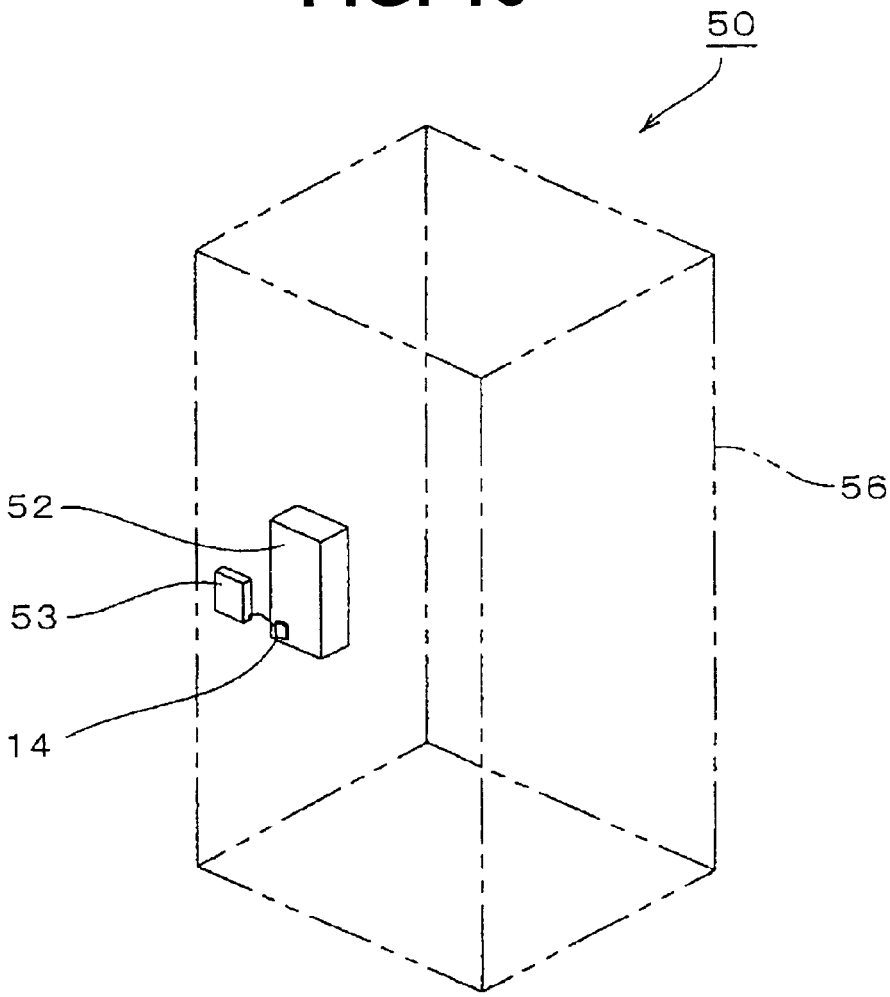
FIG. 11 is an illustrative view showing the application of the movement detection device to a cash handling machine.

FIG. 11 shows an embodiment in which the movement detection device of the present invention is applied to a cash handling machine such as a vending machine for cold beverages, cigarettes and the like, or an automated teller machine of a bank, with the aim of preventing theft.

In this case, payment from customers and change to be paid out to customers are kept at all times inside the vending machine, and money for withdrawals and money from deposits is also kept at all times inside the automated teller machine.

The cash inside the cash box of a cash handling machine, or the cash handling machine itself, is vulnerable to theft, particularly at night when the streets are deserted. In order to prevent such theft, the cash handling machines such as vending machines and automated teller machines are monitored by monitoring cameras or security guards.

However, even when monitoring cameras monitor the cash handling machine constantly, theft cannot be forestalled, and even when monitored by security guards, the danger of theft arises when the security guards move away from the cash handling machine. Hence there has been an urgent demand for a cash handling machine which informs an administrator of the cash handling machine of an occurrence of a theft as promptly as the danger of theft.

Referring to FIG. 11, a cash box 52 for storing cash is attached to a cash handling machine 50 inside a casing 56, a rectangular irregularity signaling device 14' of approximately 10 mm square by 5 mm high, for example, is attached to the cash box 52, and a predetermined electric power is supplied to the irregularity signaling device 14' from an external power source 53.

The irregularity signaling device 14' in the embodiment described above is one modification of the movement detection device of the present invention, having a substantially identical configuration to the movement detection device 14 shown in FIG. 2 with the movement detection sensor 8 shown in FIG. 1 as the constituting element thereof.

Figure 12:
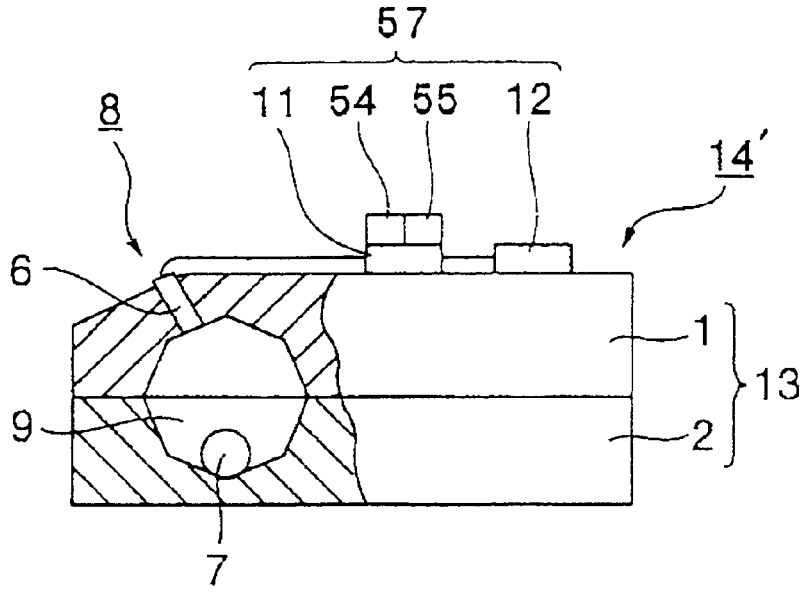
FIG. 12 is a sectional view showing an embodiment of the movement detection device serving as an irregularity signaling device.

More specifically, as shown in FIG. 12, the void 9 of the movement detection sensor constituting the irregularity signaling device (movement detection device) 14' of this embodiment takes a regular polyhedron form, and the joining face of the base plate 1 and lid plate 2 is formed by a similar method to that of the movement detection sensor 8 of the first embodiment.

The rolling member 7 is sealed inside the void 9, and the magnetic sensor 6 is attached to the base plate 1 side of the void 9 in a similar configuration to that of the movement detection sensor 8 of the first embodiment. Note that in the irregularity signaling device (movement detection device) 14', the movement detection sensor 8 is used as an vibration detection sensor 8.

A processing circuit 57 comprising an amplifying circuit 11 to which an internal battery 55 and a timer 54 are connected and a transmitting circuit 12 for a portable telephone is connected to the output side of the magnetic sensor 6 in the vibration detection sensor (movement detection sensor) 8 described above. These circuits are integrated as an IC and placed on the base plate 1.

Actions and effects of the irregularity signaling device 14' having the configuration described above will now be described.

The timer 54 is preset to a guarding period from 5 p.m. to 6 a.m., for example, during which the irregularity signaling device 14' is operated.

When the cash box 52 or the casing 56 of the cash handling machine 50 is touched by someone, the irregularity signaling device 14' vibrates, causing the rolling member 7 of the vibration detection sensor (movement detection sensor) 8 constituting the irregularity signaling device 14' to move inside the void 9. The distance between the magnetic sensor 6 and the rolling member 7 then varies, whereby the output voltage of the magnetic sensor 6 varies.

As described above, when the output voltage of the magnetic sensor 6 varies, the transmitting circuit 12 is operated to call a preset telephone.

Hence the cash handling machine 50 is capable of reporting a theft during the guarding period to a predetermined administrator of the machine 50.

Thus, a theft occurs during the guarding period can be prevented. In addition, since the irregularity signaling device 14' is provided with the internal battery 55, the preset telephone is kept to be called even when the cash handling machine 50 is carried away from a predetermined position and the power supply from the external power source 53 is cut off.

As a result, the whereabouts of the cash handling machine 50 and the person carrying the cash handling machine 50 can be clarified.

In this embodiment, the irregularity signaling device 14' comprising as its main component the vibration detection sensor (movement detection sensor) 8 which detects movement of the rolling member 7 inside the void 9 is used. However, an irregularity signaling device 41' comprising as its main component a movement detection sensor which detects acceleration of the rolling member 7 may also be used.

Figure 13:
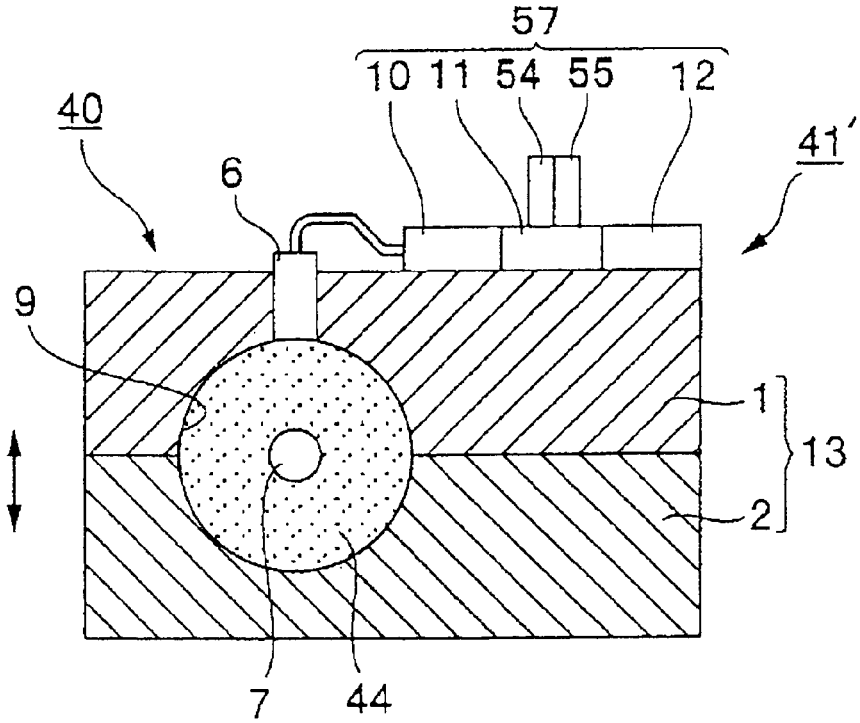
FIG. 13 is a sectional view showing another embodiment of the movement detection device serving as an irregularity signaling device.

The irregularity signaling device 41' shown in FIG. 13 is one modification of the movement detection device of the present invention, having a substantially identical configuration to the movement detection device 41 shown in FIG. 8 with the movement detection sensor 40 shown in FIG. 7 as the constituting element thereof. Note that in the irregularity signaling device (movement detection device) 41', the movement detection sensor 40 is used as an vibration detection sensor 40.

To the output side of the magnetic sensor 6 in the vibration detection sensor (movement detection sensor) 40 described above, a processing circuit 57 comprising a differentiating circuit 10, an amplifying circuit 11 to which an internal battery 55 and a timer 54 are connected and a transmitting circuit 12 for a portable telephone is connected. These circuits are integrated as an IC and placed on the base plate 1.

The output voltage of the magnetic sensor 6 is differentiated by the differentiating circuit 10, whereby an acceleration having the main component in the arrow direction is calculated. When the calculated acceleration varies, the transmitting circuit 12 is operated to call the preset telephone.

The irregularity signaling device 41' detects acceleration in only one direction. By using three of the movement detection sensors 40 shown in FIG. 7 and disposing these three sensors so as to face three directions at angles of 90° from one another, acceleration in three directions can be detected.

Further, in this embodiment, the irregularity signaling device 14' or irregularity signaling device 41' is attached to the cash box 52. Alternatively, it may be attached directly to the casing 56 of the cash handling machine 50.

In this alternative configuration, irregularities in the cash handling machine 50 including theft of the cash handling machine 50 itself may be detected and reported, thereby enabling the forestallment of the theft of the machine itself.

Also in this embodiment, the guarding period is set by the timer 54, but a serviceperson who patrols the cash handling machines 50 may input and set an arbitrary time period manually.

Further, a theft threshold may be provided for the vibration detected by the vibration detection sensor (movement detection sensor) 8 so that only when a greater vibration than the theft threshold is detected by the vibration detection sensor (movement detection sensor) 8, an irregularity in the cash handling machine 50 is determined and signaled.

With the provision of the theft threshold, it becomes unnecessary to specify a guarding period using the timer 54.

In this embodiment, the transmitting circuit 12 serves as a portable telephone transmitting circuit to make reports to a telephone. Alternatively, instead of the transmitting circuit 12 for a portable telephone, a configuration is possible in which the transmitting circuit 12 is connected to a regular subscriber telephone through a wire. Moreover, various data may be reported through a radio transmitter to a remote receiver such as a pager or radio receiver.

In the embodiment shown in FIG. 11, the movement detection device according to the present invention is provided on a cash handling machine such as a vending machine with the aim of preventing theft. However, by attaching the movement detection device according to the present invention to the body of a vehicle, theft of passenger vehicles or construction vehicles such as dump trucks can be forestalled.

In this case, if preventing a theft of passenger vehicles or the like is aimed at, a configuration may be such that, in addition to the movement detection device of the present invention for detecting vibration and acceleration, a pressure sensor is installed in the vehicle to detect the opening and closing of doors according to changes in pressure of the room of the vehicle.

Further, by attaching the movement detection device according to the present invention to possible entry routes such as doors, windows, shutters in homes, office buildings, store outlets in tenant buildings, and so on so that an illegal entry of a suspicious person is detected instantaneously by detecting an irregular operation of the door or the like, the damage caused thereby can be forestalled.

In this case, if preventing entry into a home by a suspicious person is aimed at, a configuration may be such that, in addition to the movement detection device according to the present invention, an infrared sensor is installed in an appropriate location to detect the behavior of the suspicious person.

Moreover, by appropriately combining the movement detection sensor according to the present invention with various sensors such as a pressure sensor or infrared sensor, a crime-prevention system with a variety of purposes can be constructed as well as preventing a theft of passenger vehicles and the like and the entry of suspicious persons into a home.

Further, by installing the movement detection device according to the present invention on a large exterior machine for air-conditioning equipment in a building, factory, or the like, breakage of the fan belt in the exterior machine can be monitored. More specifically, a configuration may be such that vibration in the drive shaft of a driving motor or the rotary shaft of a fan is detected by the movement detection device according to the present invention, and if the obtained vibration algorithm exceeds the allowable value of a predetermined vibration algorithm, it is determined that the fan belt is broken.

According to the present invention as described above, a first movement detection sensor comprises a void formed by a partition wall made of a non-magnetic material, a magnetized rolling member sealed inside the void, and a magnetic sensor provided in the partition wall.

Thus the magnetic sensor detects the distance between itself and the rolling member which moves within the void, and hence movement of a detection subject to which the movement detection sensor is attached can be detected.

When movement of the detection subject is detected, a preset telephone is called, and thus the theft of a valuable article or accidents and the like to a care-receiver can be prevented.

A second movement detection sensor is configured by positioning the rolling member in the substantial center of the void and then filling the void with a visco-elastic body until the visco-elastic body abuts against the rolling member.

Thus the magnetic sensor detects vibration of the rolling member, whereby vibration in the detection subject to which the second movement detection sensor is attached can be detected.

By attaching the second movement detection sensor to a transported shipping container or the like, for example, and examining a stored acceleration, which is determined by differentiating the detected vibration, following transportation when the shipping container is damaged, the time, location, and so on of damage to the shipping container can be specified easily.

Moreover, the first movement detection sensor and second movement detection sensor are configured by small components such as the partition wall, rolling member, magnetic sensor, and visco-elastic body, and thus a compact movement detection sensor with a simple configuration which can be attached easily to any position on a detection subject is obtained.

What is claimed is:

1. A movement detection sensor comprising:

a void formed by a partition wall made of a non-magnetic material;

a magnetized rolling member sealed in an interior of the void; and an opening that is provided through the partition wall and communicates from the interior of the void to outside of the void;

a magnetic sensor wall inserted into the opening with a detection end thereof directing toward the interior of the void, wherein the void is formed so that the whole inner wall of the void is in smooth spherical or regular polyhedrons form, and the rolling member is a sphere or a regular polyhedron;

an amplifying circuit that amplifies an output signal of the magnetic sensor in the movement detection sensor; and a transmitting circuit that radio-transmits a detection signal amplified in the amplifying circuit.

2. A movement detection device comprising:

the movement detection device according to claim 1; and a microcomputer that stores and judges a the detection signal amplified in the amplifying circuit of the movement detection device.

3. A movement detection device comprising:

the movement detection device according to claim 2; and a radio wave receiver attached to the movement detection device, that receives radio waves, wherein the radio wave receiver receives radio waves from a radio wave transmitter positioned at a predetermined distance from the movement detection device, and the movement detection device begins operations when a field intensity of the received radio waves falls below a predetermined value.

4. A movement detection device comprising:

the movement detection device according to claim 2;

a temperature sensor that detects the temperature of a detection subject; and an attachment tool that attaches the movement detection device and the temperature sensor to the detection subject.

5. A movement detection device comprising:

the movement detection device according to claim 1; and a radio wave receiver attached to the movement detection device, that receives radio waves, wherein the radio wave receiver receives radio waves from a radio wave transmitter positioned at a predetermined distance from the movement detection device, and the movement detection device begins operations when a field intensity of the received radio waves falls below a predetermined value.

6. A movement detection device comprising:

the movement detection device according to claim 1;

a temperature sensor that detects the temperature of a detection subject; and an attachment tool that attaches the movement detection device and the temperature sensor to the detection subject.

7. A movement detection sensor comprising:

a void formed by a partition wall made of a non-magnetic material;

a magnetized member sealed in the interior of the void;

a hole that is provided through the partition wall and communicates from the interior of the void to outside of the void;

a visco-elastic body which is filled into the void so as to abut against the magnetic member to hold the magnetic member in a predetermined position; and a magnetic sensor inserted into the hole with a detection end thereof directing toward the interior of the void;

a differentiating circuit that differentiates an output signal of the magnetic sensor in the movement detection sensor and calculates an acceleration having a main component in a predetermined direction to generate a second output signal;

an amplifying circuit that amplifies an the second output signal to generate a detection signal; and a transmitting circuit that radio-transmits a the detection signal amplified in the amplifying circuit.

8. A movement detection device comprising:

the movement detection device according to claim 7; and a microcomputer that stores and judges the detection signal amplified in the amplifying circuit of the movement detection device.

9. A movement detection device comprising:

the movement detection device according to claim 8; and a radio wave receiver attached to the movement detection device, that receives radio waves, wherein the radio wave receiver receives radio waves from a radio wave transmitter positioned at a predetermined distance from the movement detection device, and the movement detection device begins operations when a field intensity of the received radio waves falls below a predetermined value.

10. A movement detection device comprising:

the movement detection device according to claim 8;

a temperature sensor that detects the temperature of a detection subject; and an attachment tool that attaches the movement detection device and the temperature sensor to the detection subjection.

11. A movement detection device comprising:

the movement detection device according to claim 7; and a radio wave receiver attached to the movement detection device, that receives radio waves, wherein the radio wave receiver receives radio waves from a radio wave transmitter positioned at a predetermined distance from the movement detection device, and the movement detection device begins operations when a field intensity of the received radio waves falls below a predetermined value.

12. A movement detection device comprising:

the movement detection device according to claim 7;

a temperature sensor that detects the temperature of a detection subject; and an attachment tool that attaches the movement detection device and the temperature sensor to the detection subject.

* * * * *